US010302089B2

(12) United States Patent
Meyer et al.

(10) Patent No.: US 10,302,089 B2
(45) Date of Patent: May 28, 2019

(54) CIRCULATION PUMP FOR COOLING MECHANICAL FACE SEAL OF SUBMERSIBLE WELL PUMP ASSEMBLY

(71) Applicant: Baker Hughes Incorporated, Houston, TX (US)

(72) Inventors: Aron M. Meyer, Pryor, OK (US); David Tanner, Broken Arrow, OK (US); Chase Wichert, Broken Arrow, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 489 days.

(21) Appl. No.: 15/085,092

(22) Filed: Mar. 30, 2016

(65) Prior Publication Data

US 2016/0312785 A1 Oct. 27, 2016

Related U.S. Application Data

(60) Provisional application No. 62/150,519, filed on Apr. 21, 2015.

(51) Int. Cl.
*F04D 13/10* (2006.01)
*E21B 43/12* (2006.01)
(Continued)

(52) U.S. Cl.
CPC ..... *F04D 13/10* (2013.01); *E21B 43/128* (2013.01); *F04D 13/08* (2013.01); *F04D 29/061* (2013.01);
(Continued)

(58) Field of Classification Search
CPC ..... F04D 13/10; F04D 13/08; F04D 29/126; F04D 29/106; F04D 29/128; F04D 29/061; E21B 43/128
(Continued)

(56) References Cited

U.S. PATENT DOCUMENTS 2,637,531 A 5/1953 Davidson
4,406,465 A * 9/1983 Rockwood ..... F04D 29/126 277/348
(Continued)

FOREIGN PATENT DOCUMENTS

WO 2007022125 A1 2/2007

OTHER PUBLICATIONS

PCT International Search Report and Written for related application PCT/US2016/025818, dated Jul. 15, 2016.
(Continued)

*Primary Examiner* — Dominick L Plakkoottam
*Assistant Examiner* — Stephen A Mick
(74) *Attorney, Agent, or Firm* — Bracewell LLP; James E. Bradley

(57) ABSTRACT

An electrical submersible pump assembly includes a production pump, a motor containing a motor lubricant, and a seal section coupled between the motor and the pump. A drive shaft extends through the seal section, the drive shaft being rotated by the motor for driving the production pump. A mechanical face seal in the seal section seals around the shaft. A circulation pump is mounted to the shaft above the face seal for rotation therewith. An inlet passage leads from an exterior of the seal section to the circulation pump to deliver well fluid to the circulation pump. An outlet passage leads from the circulation pump to the exterior of the seal section to discharge well fluid exterior of the seal section. The rotating component of the face seal is located in the outlet passage.

20 Claims, 3 Drawing Sheets

(51) Int. Cl.

| | |
|---|---|
| ***F04D 29/06*** | (2006.01) |
| ***F04D 29/10*** | (2006.01) |
| ***F04D 29/12*** | (2006.01) |
| ***F04D 13/08*** | (2006.01) |

(52) U.S. Cl.
CPC ..... *F04D 29/106* (2013.01); *F04D 29/126* (2013.01); *F04D 29/128* (2013.01)

(58) Field of Classification Search
USPC ..... 417/423.3; 277/430; 166/84.4
See application file for complete search history.

(56) References Cited

U.S. PATENT DOCUMENTS

| | | | |
|---|---|---|---|
| 4,678,039 | A | 7/1987 | Rivas |
| 4,901,796 | A | 2/1990 | Drnevich |
| 5,620,048 | A | 4/1997 | Beauquin |
| 6,691,782 | B2 | 2/2004 | Vandevier |
| 6,851,935 | B2 | 2/2005 | Merrill |
| 7,188,669 | B2 | 3/2007 | Bullock |
| 7,207,389 | B2 | 4/2007 | Foster |
| 7,299,873 | B2 | 11/2007 | Hartman |
| 7,520,735 | B2 | 4/2009 | Merrill |
| 7,597,138 | B1 | 10/2009 | Koenig |
| 7,665,975 | B2 | 2/2010 | Parmeter |
| 7,766,081 | B2 | 8/2010 | Brown |
| 8,221,092 | B2 | 7/2012 | Chilcoat |
| 8,696,334 | B2 | 4/2014 | Hunt |
| 8,726,997 | B2 | 5/2014 | Hoffarth |
| 8,845,308 | B2 | 9/2014 | Tetzlaff |
| 2007/0140876 | A1 | 6/2007 | Parmeter et al. |
| 2009/0010773 | A1 | 1/2009 | Parmeter et al. |
| 2009/0161997 | A1 | 6/2009 | Beauchamp et al. |
| 2010/0143160 | A1 | 6/2010 | Forsberg |
| 2014/0099211 | A1* | 4/2014 | Sheth ..... F04D 13/10 417/53 |
| 2015/0023805 | A1 | 1/2015 | Pyron et al. |

OTHER PUBLICATIONS

U.S. Appl. No. 14/682,569, filed Apr. 9, 2015—"Metal Bellows Seal Section and Method to Evacuate Air During Filling"—inventors: David Tanner, Aroo M. Meyer, and Ryan P. Semple.

U.S. Appl. No. 14/548,945, filed Nov. 20, 2014—"Auxiliary Face Seal for Submersible Well Pump Seal Section"—inventors: Steven K. Tetzlaff, Lance T. Robinson, Kevin R. Bierig, and Daniel A. Shaffer.

* cited by examiner

CIRCULATION PUMP FOR COOLING MECHANICAL FACE SEAL OF SUBMERSIBLE WELL PUMP ASSEMBLY

CROSS-REFERENCE TO RELATED APPLICATION

This application claims priority to provisional application 62/150,519, filed Apr. 21, 2015.

FIELD OF THE DISCLOSURE

This disclosure relates in general to submersible well pump assemblies and in particular to a motor shaft seal section having a circulation pump to flow fluid past a mechanical shaft seal for cooling.

BACKGROUND

One type of pump assembly used particularly in oil producing wells has a submersible pump and electrical motor filled with a dielectric motor lubricant. The motor rotates a shaft assembly to drive the pump. A seal section connects between the motor and the pump. The seal section has a shaft seal to seal well fluid from contaminating the motor lubricant.

Normally, the shaft seal is a mechanical face seal having a rotating component or seal runner with an elastomeric boot mounted to the shaft for rotation with the shaft. A spring biases the seal runner against a stationary seal base. The interface between the seal runner and the seal base seals the well fluid from the motor lubricant.

The region of well fluid surrounding the upper portion of the mechanical face seal is relatively stagnant, although the rotation of the seal runner provides some disturbance to well fluid in this region. The rotational, sliding engagement of the seal runner with the seal base generates heat at the interface. Heat produced at the interface transfers through the head of the seal section and through the lubricant. In some installations, the heat transfer that occurs may be inadequate to cool the face seal to a desired temperature, thus decreasing the life.

SUMMARY

An electrical submersible pump assembly includes a production pump, a motor containing a motor lubricant and operatively coupled to the production pump for driving the pump. A seal section is coupled to the motor between the motor and the pump. A rotatable drive shaft extends through the seal section. A shaft seal in the seal section seals around the shaft. A circulation pump is mounted to the shaft and within the seal section for rotation therewith. The circulation pump has a discharge that discharges fluid around the shaft seal.

In one embodiment, the circulation pump has a hub and a helical flight mounted to the hub. The helical flight extends in a plurality of turns around the hub.

The circulation pump may be located between the shaft seal and an upper end of the seal section. The shaft seal has a rotating component and a non-rotating component. The rotating component is located in a discharge flow path of the circulation pump.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1:
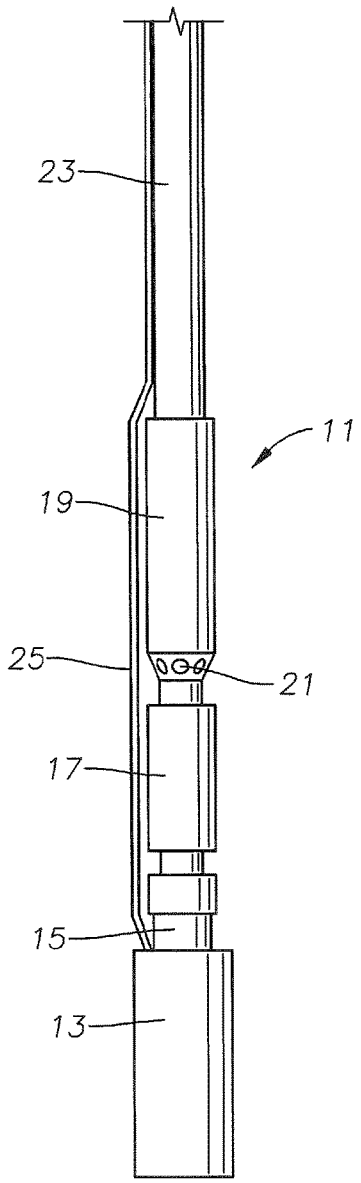
FIG. 1 is a side view of an electrical submersible pump assembly in accordance with this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, an electrical submersible pump (ESP) 11 typically includes an electrical motor 13. Motor 13 is normally a three-phase AC motor and may be connected in tandem to other motors. Motor 13 is filled with a dielectric motor lubricant for lubricating the internal rotating components. A thrust bearing unit 15 is illustrated at an upper end of motor 13. The terms "upper" and "lower" are used only for convenience and not in a limiting manner. A pressure equalizer or seal section 17 is shown connected to an upper end of thrust bearing unit 15, or thrust bearing unit 15 could be incorporated with seal section 17. In this example, seal section 17 has features to reduce a pressure differential between the motor lubricant in motor 13 and the exterior well fluid hydrostatic pressure. The pressure equalizing features of seal section 17 could alternately be located below motor 13, and shaft sealing portions of seal section 17 located above motor 13.

A production pump 19 connects to the upper end of seal section 17 in this example. Production pump 19 could be a centrifugal pump having a large number of stages, each stage having an impeller and a diffuser. Alternately, production pump 19 could be another type, such as a progressing cavity pump. A string of production tubing 23 secures to the upper end of production pump 19 and supports ESP 11 in a well. Production tubing 23 may be sections of pipe with threaded ends secured together, or it could be continuous coiled tubing. Production pump 19 has an intake 21 for drawing in well fluid, which is discharged into production tubing 23. An optional gas separator could be connected to production pump 19; if so, intake 21 would be in the gas separator. A power cable 25 extends downward alongside production tubing 23 from a wellhead (not shown) to motor 13 for supplying power to motor 13.

Figure 2:
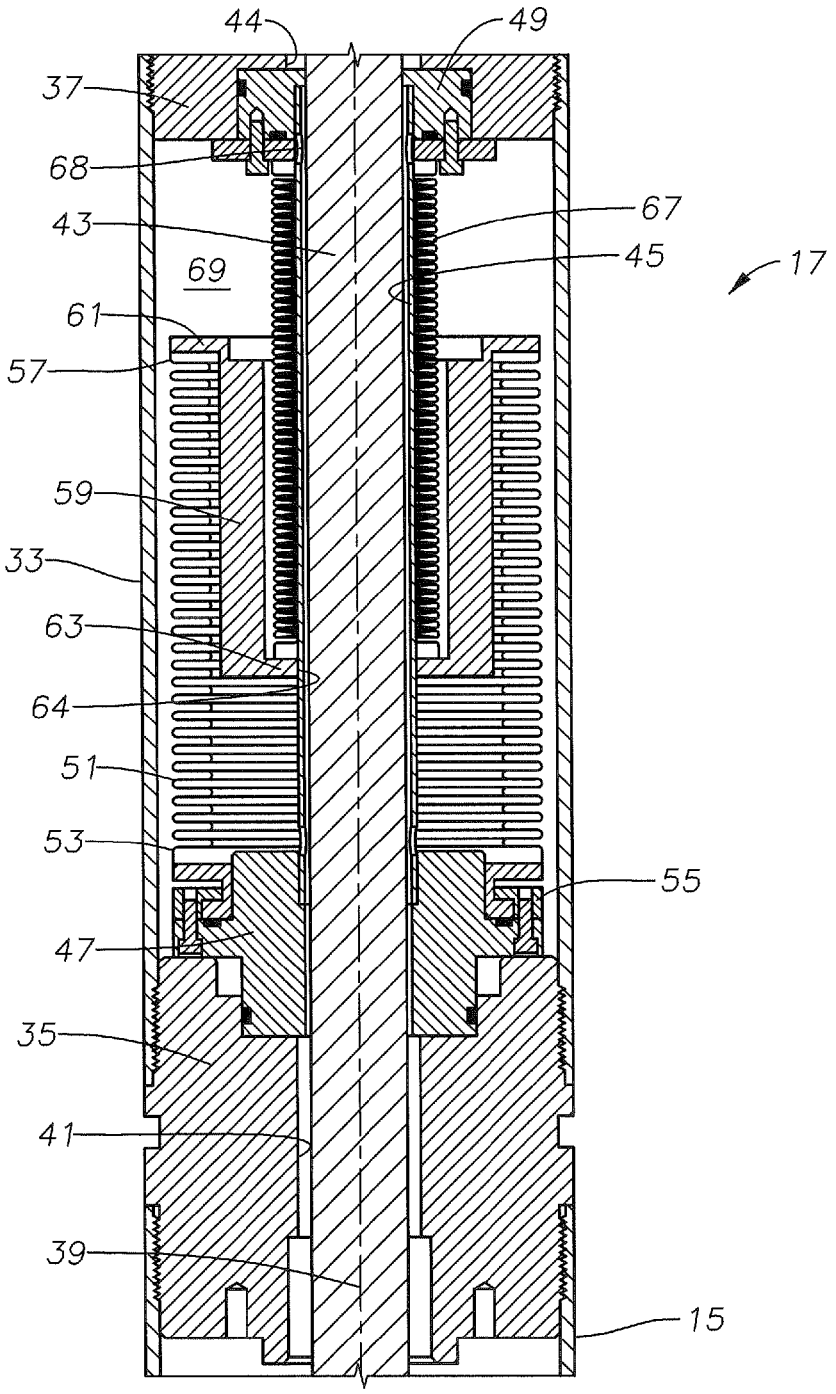
FIG. 2 is a sectional view of a pressure equalizer of the submersible pump assembly of FIG. 2.
Figure 3:
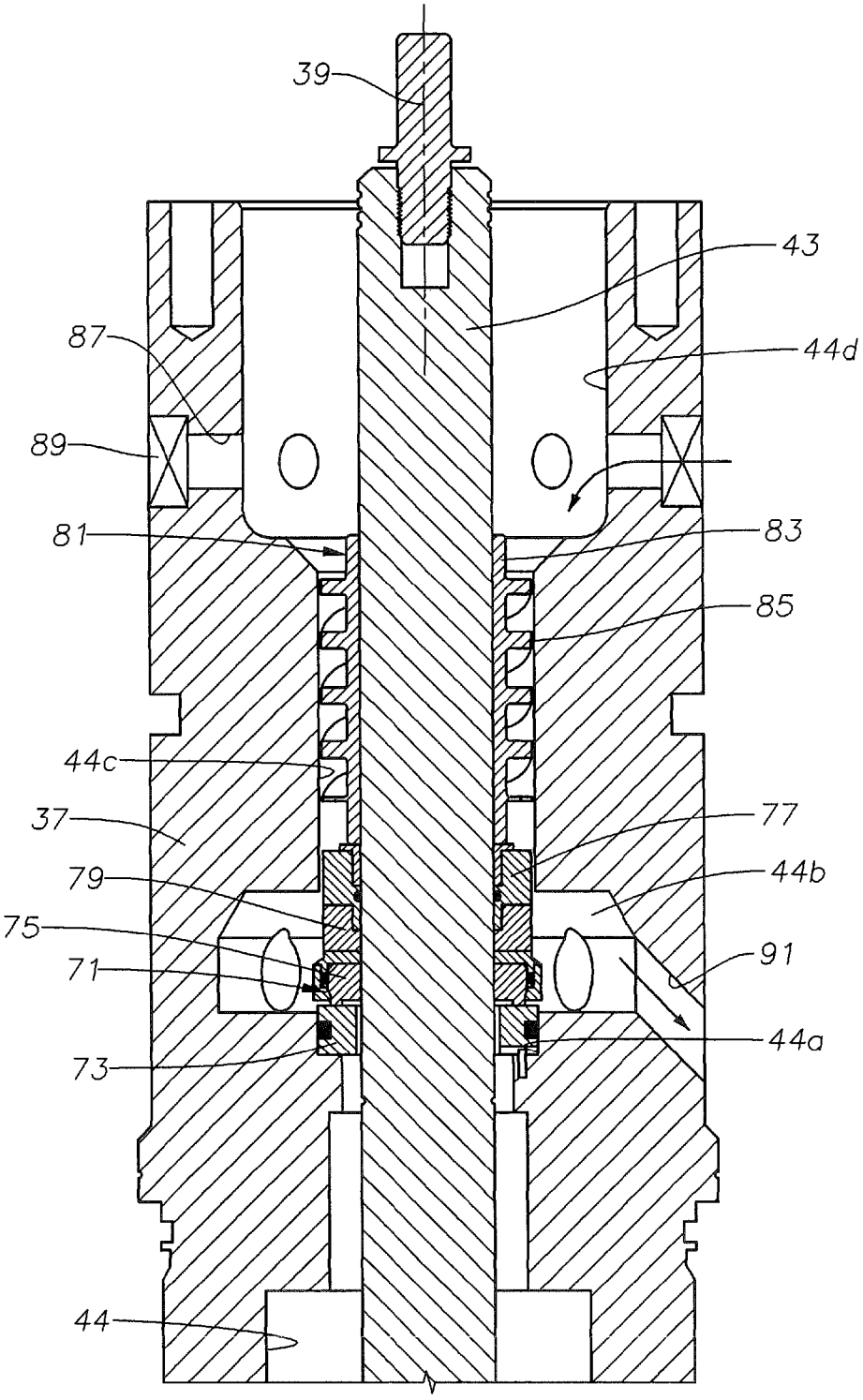
FIG. 3 is a sectional view of a head of the pressure equalizer of FIG. 2.

FIG. 2 shows one example of a pressure equalizer for seal section 17, but other types of pressure equalizers would work, including those located below motor 13. Referring to FIG. 3, seal section 17 has a cylindrical housing 33. A lower adapter 35 secures, such as by threads, to the lower end of housing 33. A head member, connector member, or upper adapter 37 secures, such as by threads, to an upper end of housing 33 and may be considered to be a part of housing 33. Lower and upper adapters 35, 37 are spaced axially apart from each other along longitudinal axis 39. Lower adapter 35 has a bore 41 through which a drive shaft 43 extends. Drive shaft 43 extends from motor 13 (FIG. 1) through a bore 44 in upper adapter 37 into engagement with production pump 19 (FIG. 1) for driving the pump. Drive shaft 43 is typically an assembly in several sections connected by splined ends. Bushings are located in lower adapter 35 and upper adapter 37 for providing radial support to drive shaft 43.

A non rotating guide tube 45 surrounds but is not in contact with shaft 43. Guide tube 45 is supported at its lower end by a lower cap 47, which mounts to lower adapter 35. Guide tube 45 is supported at its upper end by an upper cap 49, which mounts to a lower end of upper adapter 37 within a recess.

In this embodiment, seal section 17 has a metal, outer bellows 51 with an outer diameter only slightly smaller than the inner diameter of housing 33. Alternately, another type of flexible member could be employed, such as an elastomeric bag. Outer bellows 51 has a fixed or lower end 53 that is secured by a retainer 55 to lower cap 47. Outer bellows 51 has a floating or upper end 57 spaced axially above lower end 53. Outer bellows 51 is cylindrical and has a corrugated, flexible sidewall.

A cup-shaped interconnect member 59 fits within outer bellows 51. Interconnect 59 is a sleeve with an upper end 61 having an external flange that overlies and secures sealingly to outer bellows upper end 57. Interconnect 59 has a lower end 63 with an internal flange having a central opening 64 slightly larger in diameter than guide tube 45. Interconnect 59 has an outer diameter that is smaller than the inner diameter of outer bellows 51. Interconnect 59 moves up and down with outer bellows upper end 57 as outer bellows 51 moves between a contracted position and an extended position.

A metal, inner bellows 67 has a lower end within outer bellows 51. The lower end of inner bellows 67 secures and seals to lower end 63 of interconnect 59. Inner bellows 67 has an upper end that secures and seals to upper cap 49 in this embodiment. Inner bellows 67 is cylindrical, corrugated, and has a smaller outer diameter than the inner wall of outer bellows 51. The inner diameter of inner bellows 67 is slightly larger than the outer diameter of guide tube 45. One or more ports 68 communicate motor lubricant within guide tube 45 to the interior of inner bellows 67 and the interior of outer bellows 51, which are in fluid communication with each other.

A well fluid chamber 69 in housing 33 surrounds outer bellows 51 and inner bellows 67. A port (not shown) either in upper adapter 37 or lower adapter 35 admits well fluid to well fluid chamber 69. The main lubricant communication path from motor 13 (FIG. 1) to upper port 29 (FIG. 1) is through guide tube 45, because the upper end of guide tube 45 is not closed off. The interiors of guide tube 45, outer bellows 51, and inner bellows 67 define a lubricant chamber in fluid communication with the motor lubricant in motor 13 (FIG. 1).

Referring to FIG. 3, drive shaft 43 extends through bore 44 of upper adapter 37 and has an upper end that couples to a drive shaft in production pump 19 (FIG. 1). A shaft or mechanical face seal 71 mounts in bore 44 for sealing well fluid from entry into the interiors of inner bellows 67, outer bellows 51 and guide tube 45 (FIG. 2). Mechanical face seal 71 is conventional, having a non-rotating annular seal base 73 sealed within bore 44. A seal runner 75 has a lower side that sealingly engages the upper side of seal base 73 in rotating sliding engagement. A retainer 77, sealed and connected to shaft 43 for rotation therewith, joins seal runner 75 with a boot 79 that causes seal runner 75 to rotate in unison. Boot 79 has a spring that biases seal runner 75 against base 73.

A circulation pump 81 is located in bore 44 just above retainer 77. Circulation pump 81 is preferably an inducer type having a hub 83 that engages shaft 43 for rotation therewith. A helical flight 85 extends radially outward from hub 83 and has multiple turns that extend around axis 39. The lower end of circulation pump 81 abuts seal retainer 77 in this example. Other types of circulation pumps are feasible.

Bore 44 has a number of different diameters, including an annular seal base area 44*a* into which seal base 75 is rigidly secured. An annular circulation pump discharge area 44*b* joins seal base area 44*a* and extends upward. Circulation pump discharge area 44*b* has a diameter larger than seal base area 44*a* and contains seal runner 75. The diameter of circulation pump discharge area 44*b* is also larger than the outer diameter of seal runner 75 and boot 79. The upper side of seal base 73 may be flush with the lower side of circulation pump discharge area 44*b*, which is shown as a flat surface located in a plane perpendicular to axis 39.

Bore 44 has a circulation pump area 44*c* that joins the upper end of circulation pump discharge area 44*b* and extends upward at a smaller diameter than circulation pump discharge area 44*b*. The outer edges of circulation pump flight 85 are closely spaced but not touching the inner side of circulation pump area 44*c*. The outer diameter of retainer 77 is preferably slightly smaller than the outer diameters of flight 85. An upper portion of retainer 77 may be located within circulation pump area 44*c*.

Bore 44 has a larger diameter circulation pump inlet area 44*d* that joins and extends upward from circulation pump area 44*c*. The upper end of circulation pump 81 is located at the lower end of inlet area 44*d*. Inlet area 44*d* is in fluid communication with well fluid. In this embodiment, at least one inlet port 87 (four shown) extends laterally outward from bore inlet area 44*d* to the exterior of head member 37 for admitting well fluid. Filters 89 of various types may be placed within each inlet 87.

At least one outlet port 91 (three shown) joins circulation pump discharge area 44*b* and extends outward and downward to the exterior of head member 37. The junctions between outlet ports 91 and enlarged diameter chamber 44*b* are located radially outward from seal runner 75.

During operation, as shaft 43 rotates, circulation pump 81 will rotate as well as seal runner 75. Circulation pump 81 draws well fluid from inlet ports 87 and pumps the well fluid through circulation pump discharge area 44*b* and out outlet ports 91 as indicated by the arrows. The well fluid flows past portions of mechanical seal 71, providing cooling. More particularly, the well fluid flows around retainer 77, boot 79 and alongside seal runner 75. The cooling caused by the circulation of well fluid over portions of mechanical seal 71 increases the life of the seal.

While the disclosure has been shown and described in only one of its forms, it should be apparent to those skilled in the art that changes may be made. For example, the turns of the circulation pump flights could be reversed, cause well fluid to flow in from the lower side and be discharged out the upper side of the circulation pump. In addition to being in a head member, the circulation pump could be located between chambers of a pressure equalizer for circulating motor lubricant over an intermediate mechanical seal, rather than well fluid.

The invention claimed is:

1. An electrical submersible pump assembly, comprising:
a production pump;
a motor containing a motor lubricant and operatively coupled to the production pump for driving the production pump;
a seal section coupled to the motor between the motor and the production pump, the seal section having a housing;
a rotatable drive shaft extending through the seal section;
a shaft seal in the seal section that seals around the shaft;
a circulation pump mounted to the shaft and within the seal section for rotation therewith relative to the housing;
a first flow passage leading from an exterior of the seal section to the circulation pump;
a second flow passage leading from the shaft seal to the exterior of the seal section; and wherein
the first and second flow passages are in fluid communication with each other, defining a flow path for fluid on the exterior of the seal section to be pumped by the circulation pump around at least a portion of the shaft seal.

2. The assembly according to claim 1, wherein the circulation pump comprises:
a hub; and
a helical flight mounted to the hub and extending in a plurality of turns around the hub.

3. The assembly according to claim 1, wherein the circulation pump is located between the shaft seal and an upper end of the seal section.

4. The assembly according to claim 1, wherein:
the shaft seal has a rotating component and a non-rotating component; and
wherein the rotating component is located in the flow path of the circulation pump.

5. An electrical submersible pump assembly, comprising:
a production pump;
a motor operatively coupled to the production pump for driving the production pump;
a seal section coupled to the motor, the seal section comprising:
a housing having a longitudinal axis and a connector member at one end, the connector member having an axial bore;
a rotatable drive shaft extending through the housing and through the bore;
an annular mechanical seal base mounted non rotatably in the bore, the seal base having an opening through which the shaft extends;
an annular seal runner mounted to the shaft within the bore for rotation therewith, the seal runner having a face that slidingly engages the base;
a circulation pump mounted to the shaft for rotation therewith within the bore adjacent the seal runner;
a first flow passage leading from the circulation pump to an exterior of the connector member;
a second flow passage leading from the seal runner to the exterior of the connector member; and wherein
the first and second flow passages are in fluid communication with each other, creating a flow path for the circulation pump to circulate well fluid from the exterior of the connector member over the seal runner for cooling.

6. The assembly according to claim 5, wherein one of the first and second flow passages comprises an inlet that intersects the bore and extends laterally through the connector member to the exterior of the connector member for delivering well fluid to an intake of the circulation pump.

7. The assembly according to claim 6, further comprising:
a filter at the inlet.

8. The assembly according to claim 6, wherein the other of the first and second flow passages comprises:
an outlet axially spaced from the inlet and extending from the bore for discharging well fluid pumped by the circulation pump to the exterior of the seal section.

9. The assembly according to claim 5, wherein:
the first flow passage comprises an inlet extending from the exterior of the seal section to an intake of the circulation pump for admitting well fluid to the intake of the circulation pump; and
the second flow passage comprises an outlet extending from a discharge of the circulation pump to the exterior of the seal section for discharging well fluid pumped by the circulation pump to the exterior of the seal section.

10. The assembly according to claim 5, wherein:
the first flow passage comprises an inlet extending laterally from the exterior of the connector member into the bore for admitting well fluid to an intake of the circulation pump; and
the second flow passage comprises an outlet extending from the bore laterally outward from the seal runner through the connector member to the exterior of the connector member for discharging well fluid pumped by the circulation pump to the exterior of the connector member.

11. The assembly according to claim 5, wherein the circulation pump comprises:
a hub;
a helical flight mounted to the hub and extending in a plurality of turns around the hub; and wherein
an outer edge of the helical flight is closely spaced to an inner side surface of the bore.

12. The assembly according to claim 5, wherein:
the bore has an annular seal base area joined on an upper end by an annular circulation pump discharge bore area having a larger diameter than the seal base area;
the bore has a circulation pump area extending upward from the circulation pump discharge bore area and being of smaller diameter than the circulation pump discharge bore area;
the seal base is mounted in the seal base area;
the seal runner is located in the circulation pump discharge bore area;
the circulation pump is located in the circulation pump area; and
the second flow passage leads from the circulation pump discharge bore area laterally to the exterior of the connector member.

13. The assembly according to claim 12, wherein:

the bore has an annular circulation pump intake area above and of larger diameter than the circulation pump area; and the first flow passage leads laterally from the exterior of the connector member to the circulation pump intake area to admit well fluid to the circulation pump intake area.

14. The assembly according to claim 5, further comprising:

a movable pressure equalizing element in the housing of the seal section, the pressure equalizing element having one side in fluid communication with lubricant in the motor for equalizing a pressure of the lubricant with well fluid on the exterior of the seal section.

15. An electrical submersible pump assembly, comprising:

a production pump;

a motor containing a motor lubricant;

a seal section coupled between the motor and the production pump, the seal section having a movable pressure equalizing element with one side in contact with well fluid and another side in fluid communication with motor lubricant in the motor;

a drive shaft extending through the seal section, the drive shaft being rotated by the motor for driving the production pump;

a mechanical face seal in the seal section that seals around the shaft, the face seal having a seal runner that rotates with the shaft and slidingly engages a non-rotating base;

a circulation pump mounted to the shaft for rotation therewith above the face seal and within the seal section, the circulation pump having an intake and a discharge;

an inlet passage leading from an exterior of the seal section to the intake of the circulation pump to deliver well fluid to the circulation pump;

an outlet passage leading from the discharge of the circulation pump to the exterior of the seal section to discharge well fluid exterior of the seal section; and wherein the rotating component of the face seal is located in the outlet passage.

16. The assembly according to claim 15, wherein the outlet passage comprises:

an annular circulation pump discharge area surrounding and of larger inner diameter than an outer diameter of the rotating component; and an outlet port extending from the circulation pump discharge area to the exterior of the seal section.

17. The assembly according to claim 16, wherein the inlet passage comprises:

an annular circulation pump intake area of larger inner diameter than an outer diameter of the circulation pump; and an inlet port extending from the exterior of the seal section to the circulation pump intake area.

18. The assembly according to claim 15, wherein the circulation pump comprises:

a hub that closely receives and rotates with the shaft; and a helical flight mounted to the hub and extending in a plurality of turns around the hub.

19. The assembly according to claim 18, wherein:

the circulation pump is located in an annular circulation pump area surrounding the shaft; and the helical flight has an outer edge closely spaced to the circulation pump area.

20. The assembly according to claim 15, further comprising:

a filter in the inlet passage.

* * * * *